United States Patent [19]

Blain

[11] Patent Number: 5,010,821

[45] Date of Patent: Apr. 30, 1991

[54] DUAL PURPOSE ENERGY TRANSFER CORD

[75] Inventor: Jim W. Blain, Scotts Valley, Calif.

[73] Assignee: Lockheed Missiles & Space Company, Inc., Sunnyvale, Calif.

[21] Appl. No.: 945,047

[22] Filed: Dec. 22, 1986

[51] Int. Cl.[5] ..... C06C 5/04

[52] U.S. Cl. ..... 102/275.8; 102/275.5

[58] Field of Search ..... 102/275.1-275.12, 102/201

[56] References Cited

U.S. PATENT DOCUMENTS

| | | | |
|---|---|---|---|
| 3,528,372 | 9/1970 | Lewis et al. | 102/201 |
| 3,590,739 | 7/1971 | Persson | 102/275.5 |
| 3,618,526 | 11/1971 | Baker | 102/201 |
| 3,911,822 | 10/1975 | Boling | 102/201 |
| 3,987,733 | 10/1976 | Spraggs et al. | 102/275.4 |
| 4,328,753 | 5/1982 | Kristensen et al. | 102/275.8 X |
| 4,455,941 | 6/1984 | Walker et al. | 102/275.8 |
| 4,493,261 | 1/1985 | Simon et al. | 102/275.8 X |
| 4,607,573 | 8/1986 | Thureson et al. | 102/275.8 |

FOREIGN PATENT DOCUMENTS

| | | | |
|---|---|---|---|
| 752770 | 7/1956 | United Kingdom | 102/275.1 |

*Primary Examiner*—David H. Brown

*Attorney, Agent, or Firm*—Rodger N. Alleman

[57] ABSTRACT

A dual-purpose energy transfer/signal transmission line including a hollow tubular cord containing on the inner surface thereof a thin layer explosive, the ignition of which creates a shock wave of energy perpetuated through the cord, in which the cord contains a fiber-optic or electrical signal transmission line of substantially smaller diameter than the ID of the explosive cord. The invention also includes junction blocks allowing ingress/egress of the signal line into and out of the explosive cord.

10 Claims, 5 Drawing Sheets

DUAL PURPOSE ENERGY TRANSFER CORD

TECHNICAL FIELD

Figure 2:
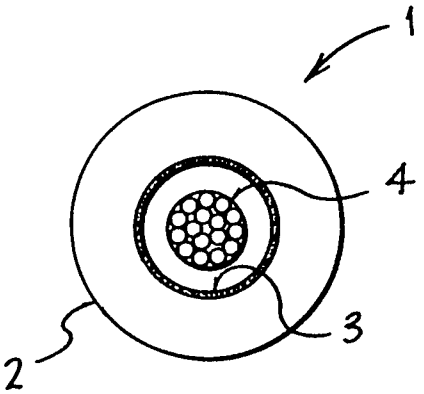

This invention relates generally to the field of ordnance devices and more specifically to a device/system for transmission of relatively high-energy pulses which may be used to detonate additional explosive trains, or the functioning of ordnance devices such as pinpullers, cover separators, gas generator ignitors, munitions ejectors, and other systems. This invention combines the advantages of industrially-proven "thin layer explosive" (TLX) energy transmission cords with wire or fiber-optic communication systems within the confines of such conventionally sized TLX explosive cords, the combination of which is expected to be useful where space or design requirements dictate compactness. The increased "density" of packaging contributes to overall size, weight and cost reduction which is often desirable in military as well as industrial applications.

BACKGROUND OF THE INVENTION

The prior art contains many patents and teachings of explosively actuated energy transferral "cords" which operate either:

(1) in the mode of a "fuse", a relatively slow-moving containment of explosive composition encased within a wrapping, the "burning" of which fuse transfers energy to initiate an explosive in a remote location, or (2) a detonating fuse, constituting a core of explosive encased within a wrapping, ignition of which initiates a relatively fast-moving linear explosion which, in turn, initiates a remote charge which may be utilized to produce a desired work function.

In the early 1970's, in an effort to reduce weight and costs, and to simplify an improved product, it was proposed to utilize a "fuse" containing only a very small amount of explosive material placed in a very thin layer on the inner portion of a cord or tube. An example of this "thin-layered explosive" is contained in U.S. Pat. No. 3,590,739 issued to Persson on July 6, 1971. Briefly, this patent utilized a very thin layer of PETN, RDX, or HMX explosive materials on the internal surface of a tubular cord, the ignition of which material caused the creation of a shockwave of energy which was perpetuated down through the cord, at the end of which a larger explosive charge was initiated to accomplish a desired function. The Persson patent suggests that the otherwise hollow core may contain, either as an integral part of the surrounding sheath or as a separate member, a support member which extends longitudinally through the tubular chamber.

An earlier U.S. Pat. issued to Hicks in 1964, i.e., No. 3,125,024 shows an explosive cord contained within a multi-layered sheath, the explosive content of which, compared to TLX, is relatively heavy.

U.S. Pat. No. 4,220,087 issued Sept. 2, 1980, to Posson shows a thin-layered explosive on the inside of a containing sheath and which is also provided with one or more "strands" of explosive which may contain supporting wires or strands extending longitudinally through the core of the structure.

SUMMARY OF THE INVENTION

The instant invention takes advantage of the capabilities of the prior art, particularly prior art thin-layer explosive cords, while at the same time producing a dual purpose energy transfer line which can permit, in addition to an explosive "signal", an electrical or laser (light) signal within the same line. The invention contemplates that the electrical or fiber optic member may be introduced into and exited from the explosive cord at essentially any chosen location in a span or length of such cord and also contemplates the utilization of low-cost, lightweight, and relatively simple termination/-junction fixtures. The system thus created can be highly useful in "packaging" or design applications where space is at a premium, e.g., in small munitions, missiles, or other applications. Thus, the dual purpose system of the invention combines the advantages of the TLX cord's lightweight and lower cost to advantage. Further, it is envisioned that with current and future modular weapons systems, warhead and munitions fuzing functions requiring various types of discrete electrical, optical and explosive signals transmited at timed intervals can be accommodated.

Accordingly, it is an object of this invention to provide an explosive cord energy transmission system which, over at least a portion of its length, may contain an electro-optic or electronic signal transmission means.

A further object of the invention is to provide such an explosive cord in which the signal transmission means may be introduced into and exited from the explosive cord without disrupting the explosive train timing/reliability.

An additional object is to provide such a system which will enable higher density and ease of "packaging" in the design of various ordnance devices and which will usually result in cost savings and weight savings, while contributing to size reduction.

Figure 1:
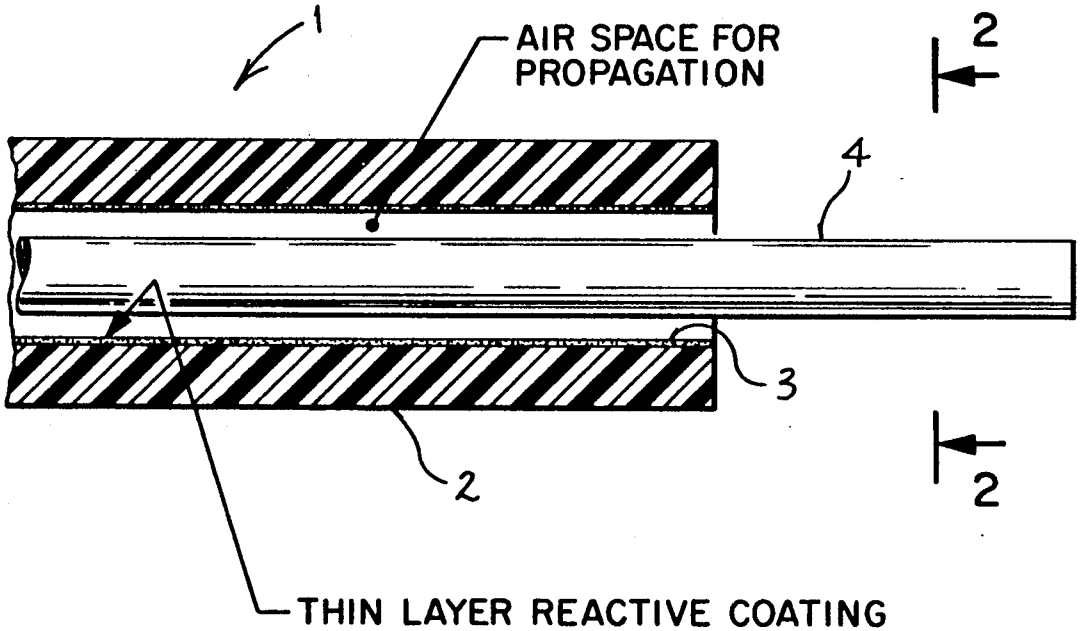
Figure 3:
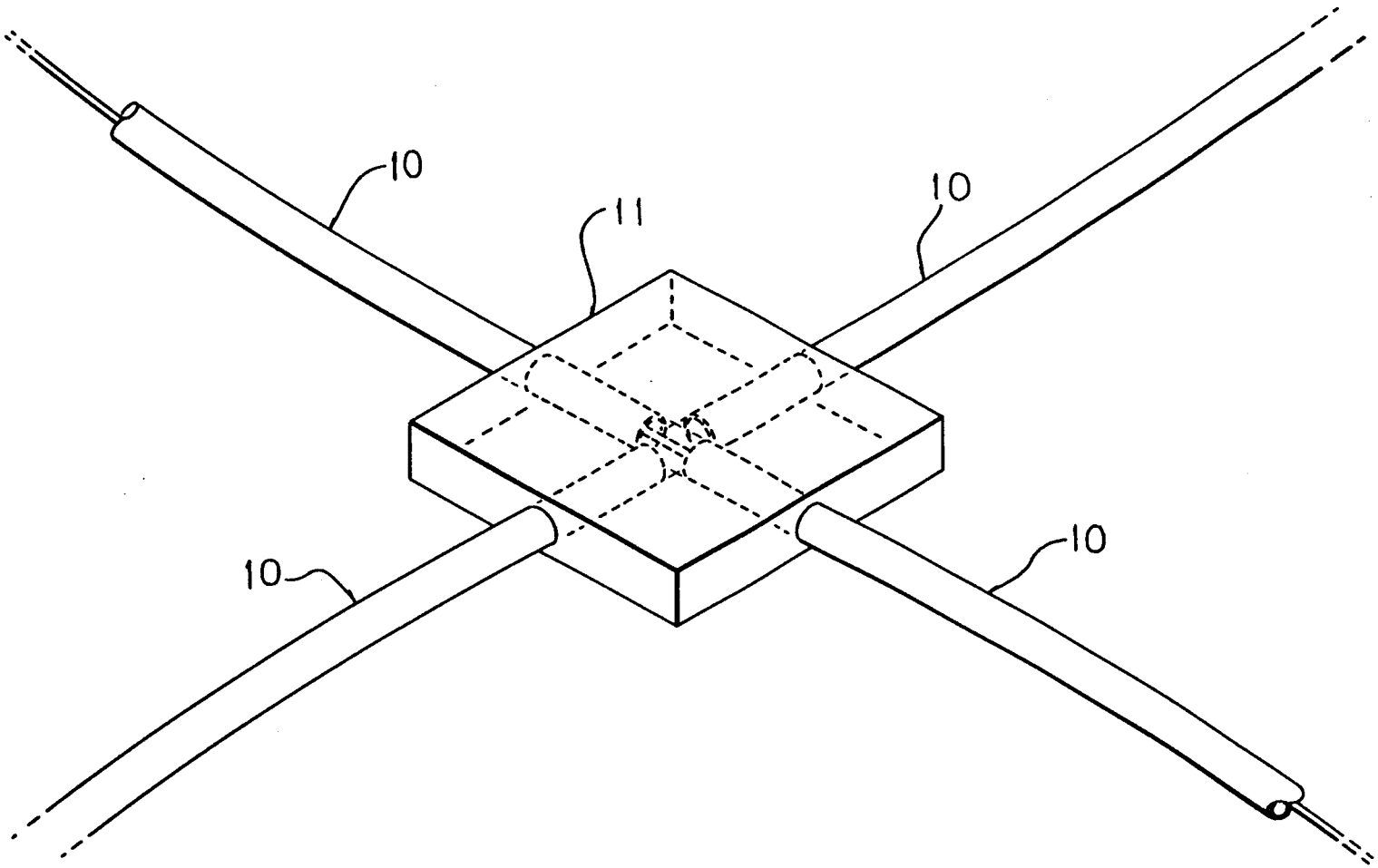
Figure 4:
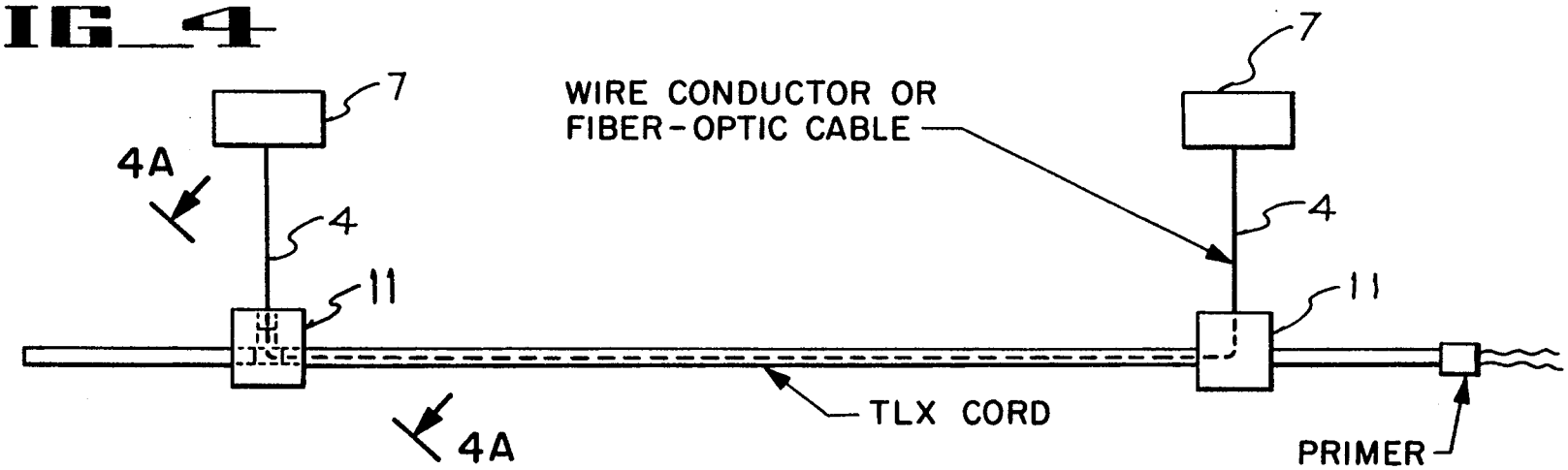
Figure 4A:
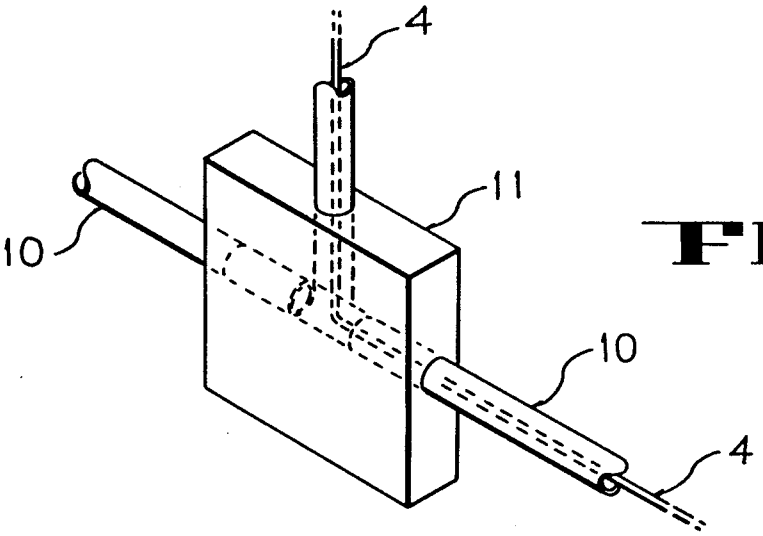
Figure 5:
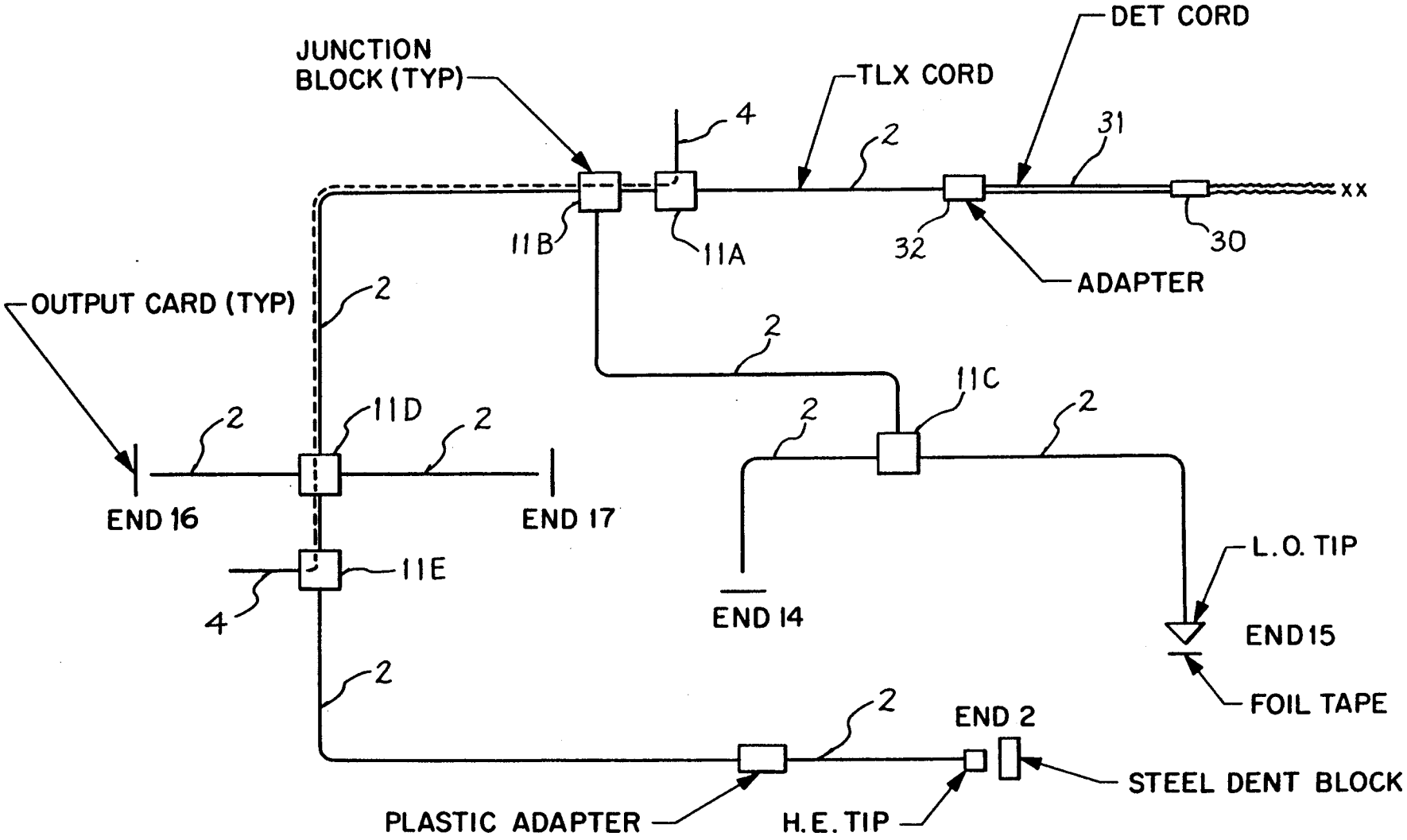
Figure 6:
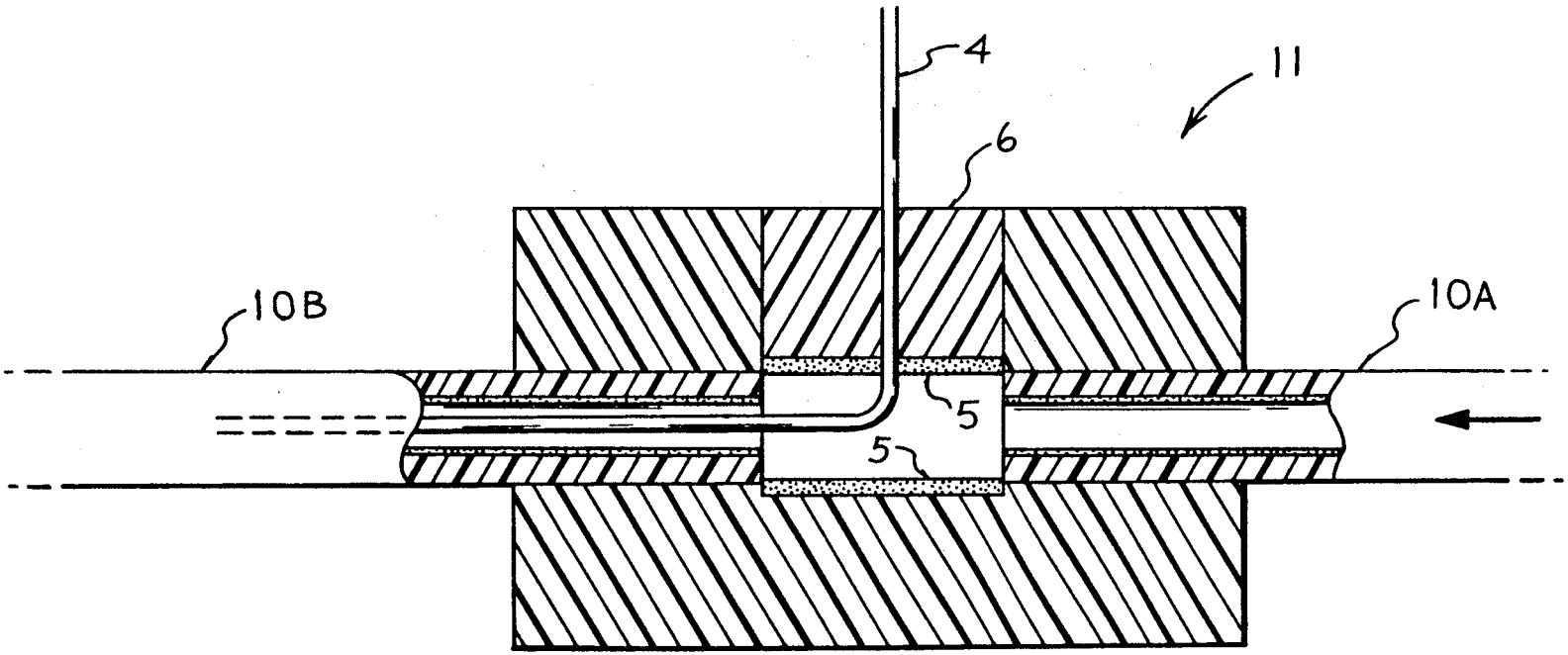

These and other objects of the invention will be understood with reference to the accompanying drawings and description wherein:

FIG. 1 is a side cross-sectional view of a TLX explosive cord containing a signal transmissive member, FIG. 2 is a cross-sectional or end-view of the device of FIG. 1, FIG. 3 is a typical four-way connector which may be utilized to interconnect multiple "runs" of thin-layered explosive (TLX), FIG. 4 is a schematic showing of a TLX cord with junction blocks for signal transmission means ingress/egress, FIG. 4*a* is an isometric view of a junction block, e.g., as shown in FIG. 4, FIG. 5 is a schematic of a theoretical system utilizing the present invention and, FIG. 6 is a cross-sectional view of an entry junction illustrating the entry or exit from a TLX line of a signal transmission means.

With particular reference to FIGS. 1 and 2 of the drawing, a dual-purpose explosive cord (1) in accordance with the invention is shown in which a suitable material, preferably a non-conductive plastic constituting a cord or tube (2) is provided which is coated on the inner surface with a thin layer (3) of pentaerythritoltetranitrate (PETN), cyclotrimethylenetrinitramine (RDX), cyclotetramethylenetetranitramine (HMX), a mixture of HMX and aluminum powder, or other suitable explosive, for example as described in the above-noted Pat. No. 3,590,739. This coating is preferably only a few microns thick and weights about 10–30 milligrams per meter. Containment is possible by using only lightweight construction materials and methods for the cord and related fittings, it being noted that the thin layer of explosive would burn, though would not explode, on an open flat surface. When "contained", with the products of expansion/ explosion allowed to propagate through the gas "chamber", the reaction sustains itself in a manner to produce the rapid advance of a percussive front through the length of TLX cord.

Inserted within the chamber created within cord or tube (2) is signal transmission means (4) which may be one or more fiberoptic tubes, a conducting wire, or a group of conducting wires, either insulated from each other or not as the requirements of a given application would dictate. Desirably, the nominal air gap between the internal diameter of the TLX coating, and the wire or fiberoptic "cable" 0.D. in inches is indicated in Table I, which also provides for the indicated samples, the percentage cross-sectional area occupied by the signal transmission means compared to the air gap, i.e., the available space where the TLX reactive coating propagates down the line.

TABLE I

| TLX Test Line Configuration | Nominal Air Gap Between TLX I. D. and Wire O. D. (inches) | Nominal Air Gap Between TLX I. D. and Fiber Optic O. D. (inches) | TLX I. D. Cross Sectional Area Occupied % |
|---|---|---|---|
| *Surlyn/24 Gage Wire | .007 | — | 42.3 |
| Halar/30 Gage Wire | .003 | — | 40 |
| Surlyn/Fiber Optic | — | .009 | 50 |

*"Surlyn" is a trademark of DuPont Corporation referring to an ionomer plastic material of ethylene methacrylate.
"Halar" is a trademark of Allied Corporation referring to an ethylene-chlorotrifluoroethylene plastic material. (See Modern Plastics Encyclopedia '83-'84)

The references to an air gap noted in Table I are defined as the available space where the TLX reactive coating propagates down the line or tube.

With reference to FIG. 3, a diagramatic representation of a test arrangement is shown in which four TLX lines 10 communicate into a junction block 11, preferably of suitable plastic. The TLX lines may be secured to junction block 11 with a suitable adhesive such as five-minute epoxy. It is noted that the introduction of the TLX lines 10 into a junction block such as shown at 11 will provide continuity of propagation through the block even though the coating is "interrupted".

With reference to FIG. 4, a TLX cord designated 10 is shown in combination with a pair of junction blocks 11 such as are shown in greater detail in FIG. 4A. In FIG. 4A, TLX lines 10 intercommunicate in a generally abutting or facing manner as shown by the dotted lines and TLX lines 10 are provided with notches or a complete discontinuity so as to allow the introduction of signal transmission means 4. In FIG. 4, a pair of junction blocks 11 are provided showing a signal transmission means 4 entering into the TLX cord at one block and exiting at the other to accommodate connection to a suitable signal generation/reception or processing means 7 which could be any type of electrical signal generation means, or in the case of fiber optics, a light generating/receiving means.

As will be noted hereinbelow, a signal transmission means (wire) was inserted into a TLX line, which was then initiated or "blown". The electric wire resistance remained essentially unchanged and undamaged by the explosive operation of the TLX cord. It is contemplated that operation of the signal transmission means before, during, or after initiation of the TLX cord would be accommodated by the system, and the same would be true with respect to a fiber optics signal transmission means.

In FIG. 5 a general system is schematically shown which illustrates versatility and expandability of the dual purpose explosive system. In this figure, a primer 30 which may be electrically initiated in a conventional manner, is attached to and initiates a detonating cord 31 which is connected by a plastic adapter 32 to a TLX cord 2 which is, in turn, provided with a junction box 11A through which TLX cord 2 passes and which is adapted to accommodate in the manner hereinbelow described in connection with FIG., 6 a signal transmission means 4. The output side of junction block 11A is connected through a continuation of cord or tube 2 to junction block 11B which, in turn, branches into an additional TLX cord 2 which may be provided with an additional junction box 11C to accommodate the "splitting" of the TLX lines into two additional lines, each of which has an end function, for example, as shown at end 14 which is open, and at end 15, which is a low-explosive tip (which, in turn, could initiate an explosive device). In a similar manner, a junction block 11D accommodates the splitting of an explosive propagation into ends 16 and 17 which may be "ended" into suitable explosive devices, not shown.

Junction block 11A accommodates the introduction into cord or tube 2 of a signal transmission means 4 which is schematically shown by dotted line to pass through two junction blocks 11B and 11D, exiting the system through junction block 11E.

In FIG. 6, junction block 11 is shown to accommodate the interconnection of TLX lines 10A and 10B, and additionally shows signal transmission means 4 in conjunction with the TLX lines. It is desirable that the signal transmission means 4 be sealed in relation to the internal portion or chamber of junction box 11, as, for example, by a plug 6 which may be continuous or semi-continuous collar or a "plug" of suitable cement engaging signal transmission means 4. The walls of the internal chamber may, if desired, be provided with a coating or thin layer of explosive as shown at 5.

In the following examples, conventional 24 and 30-gage teflon-coated, stranded, copper wire was utilized, though as mentioned above, either a single strand, or a "cable" constituting a plurality of insulated conductors could be utilized, depending upon sizing compatability with the TLX cord. Fiber optic line used was representative of the type used in laser initiated ordnance devices and is commercially available.

Plastic connectors and fittings used in the experiments were either simple machined parts made from nylon molded items or procured as commercially available equipment, commonly available for pennies a piece.

Information regarding the TLX jacket or tube material is shown in Table II.

TABLE II

| TLX Jacket Material | O. D. Inches | I. D. Inches | I. D. Cross Section Area-Sq. In. | Reactive Material |
|---|---|---|---|---|
| Surlyn | .116 | .058 | .0026 | HMX/ALUM 10-30 MG-METER |
| Halar | .120 | .038 | .0013 | HMX/ALUM 10-30 MG-METER |

NOTE: The difference in cross sectional area is 2 to 1. All dimensions are nominal.

It is noted that the Surlyn jacket material is no longer produced commercially though it was evaluated because it provided a larger internal diameter than the Halar type which was more compatible with the fiber optic line. TLX can be tailored to fit any cross-section that will properly accommodate a wire or fiber optic line.

Table II provides information on the dimensions and types of reactive material utilized in the TLX cord used in the examples/experiments, and Table III describes the wire and fiber optic lines utilized.

TABLE III

| Transmission Line | O.D. Inches | O.D. Cross Section Area-Sq. In. |
|---|---|---|
| 24-Gage Teflon Coated Wire | .043 | .0015 |
| 30-Gage Teflon Coated Wire | .031 | .0008 |
| Fiber Optic Line | .041 | .0013 |

All test samples were functioned at ambient conditions. To verify the function of the TLX, a piece of white card stock was folded over the end of the TLX. A normal function was indicated by the deposit of black soot on the card. All initiations used a dupont DFP-9 electrical initiator (containing approximately 1.5 to 1.8 grains of lead azide). It is noted, however, that the TLX cord can be reliably initiated using percussion primers, stab primers, and electric detonators, detonating cord, and slapper devices.

EXAMPLES 1-3

These three tests were conducted with a key objective of determining (a) if a TLX propagation signal can be transmitted through the area obstructed by a signal transmission means, and (b) if the signal transmission means would survive the propagation environment of heat, pressure, and shock. Tests 1-3 were set up and functioned in accordance with Table IV.

TABLE IV

| Test # | Type of TLX | Length of TLX | Wire Size Gage | Wire Engagement into TLX | Results |
|---|---|---|---|---|---|
| 1 | Surlyn | 12 Inches | 24 | 9 Inches | Normal Function |
| 2 | Halar | 12 Inches | 30 | 9 Inches | Normal Function |
| 3 | Halar | 30 Inches | 30 | 18 Inches | Normal Function |

As indicated, test results showed normal function of the TLX cord, and in all cases the signal transmission means (wire) was intact and not ejected.

EXAMPLE 4

A more elaborate test was conducted wherein a piece of 24-gage wire was generally coaxially located in the TLX cord over a distance of 24 inches. Plastic junction blocks permitted the entry and exit of the wire from the cord and yet allowed end initiation and exit of the TLX output signature in normal fashion. Test results are as follows:

TABLE V

| Test No. | Type of TLX | Harness | Wire Size Gage | Wire Engagement into TLX | Results |
|---|---|---|---|---|---|
| 2 | Surlyn | 36 Inches | 24 | 24 Inches | Normal Function |

The test results were successful and continuity checks made on the wire before and after the function range from 0.459 to 0.463 miliohms, and was considered undamaged.

EXAMPLE 5-6

Two tests similar to Example 4 were conducted utilizing a 0.041 diameter fiber optic cable. Test results are as shown in Table Z.

TABLE Z

| Test No. | Type of TLX | Length of Harness | Fiber Optic Cable Engagement into TLX | Results |
|---|---|---|---|---|
| 1 | Surlyn | 36" | 24" | Normal Function |
| 2 | Surlyn | 36" | 24 | Normal Function |

Normal function of the TLX was observed and the fiber optic cable was intact and undamaged at the end of the tests.

The tests conducted indicate that Surlyn and Halar TLX cord will function normally in short lengths with approximately 50% of the cross sectional area occupied by a wire conductor or fiber optic line. Three and four-way plastic junction blocks worked well in containing and transferring the TLX propagation signal through the block.

While several embodiments of the invention have been shown and described, it is understood that the invention is to be limited only by the terms of the claims as appended hereinbelow.

What I claim is:

1. A percussive reaction transferral/signal transmission means comprising a tubular structure defining a hollow, elongated, gas channel, means for creating and sustaining a percussion wave within said channel, said percussion sustaining means comprising a reactive substance distributed as a thin layer on the inner surface of said tube, and signal transmission means contained as the only other element within said channel, said signal transmission means having an outer diameter substantially less than the inner diameter of said reactive substance.

2. A percussive reaction transferral/signal transmission means as claimed in claim 1 in which said signal transmission means is a wire conductor.

3. A percussive reaction transferral/signal transmission means as claimed in claim 1 in which said signal transmission means is at least one fiber optic conductor.

4. A percussive reaction transferral/signal transmission system comprising a tubular structure defining a hollow, elongated, gas channel, means for creating and sustaining a percussive wave within said channel, said percussion sustaining means comprising a reactive substance distributed as a thin layer on the inner surface of said tube, signal transmission means contained within at least a portion of said channel, and at least one junction means joined to said tubular structure providing access for said signal transmission means to/from the interior of said channel.

5. A percussive reaction transferral/signal transmission system as claimed in claim 4 in which said junction means comprises:

a junction block, at least two intersecting passageways in said junction block, the internal dimensions of at least one of said passageways being essentially the same size and shape as the outer dimensions of said tubular structure, thus to provide a snug fit for a tubular structure is inserted into a passageway, said signal transmission means exiting said junction block through an intersecting passageway, and plug means sealing the space between said signal transmission means and the walls of said passageway.

6. A percussive reaction transferral/signal transmission system as defined in claim 5 in which the walls of said passageways are coated with percussion sustaining means.

7. A percussive reaction transferral/signal transmission system as claimed in claim 5 in which said signal transmission means comprises at least one insulated wire conductor.

8. A percussive reaction transferral/signal transmission means as claimed in claim 5 in which said signal transmission means comprises at least one fiber optic conductor.

9. A percussive reaction transferral/signal transmission system comprising:

a tubular structure defining a hollow, elongated, gas channel, means for creating and sustaining a percussive wave within said channel, said percussion sustaining means comprising a reactive substance distributed as a thin layer on the inner surface of said tubular structure, signal transmission means contained within at least a portion of said channel, first and second junction means joined to said tubular structure providing access for said signal transmission means to/from the interior of said channel, each of the portions of signal transmission means exiting said channel through said junction means being connected to signal processing means.

10. A percussive reaction transferral/signal transmission system as claimed in claim 9 in which said junction means comprise:

a junction block, at least three intersecting passageways in said block, the internal dimensions of at least two of said passageways being essentially the same size and shape as the outer dimensions of said tubular structure, a tubular structure contained within two of said intersecting passageways, said signal transmission means exiting said junction block through the third intersecting passageway,

* * * * *